United States Patent [19]

Bickerstaff

[11] Patent Number: 4,589,227

[45] Date of Patent: May 20, 1986

[54] SIDE WINDOW GLASS REGULATOR FOR QUARTER WINDOWS ON CONVERTIBLES

[75] Inventor: David J. Bickerstaff, West Bloomfield, Mich.

[73] Assignee: Ferro Manufacturing Corporation, Southfield, Mich.

[21] Appl. No.: 605,551

[22] Filed: Apr. 26, 1984

[51] Int. Cl.[4] ..... E05F 11/52

[52] U.S. Cl. ..... 49/227; 49/352; 49/360

[58] Field of Search ..... 49/227, 352, 360

[56] References Cited

U.S. PATENT DOCUMENTS

| | | | |
|---|---|---|---|
| 2,876,003 | 3/1959 | Probst | 49/227 |
| 3,591,983 | 7/1971 | Hanson | 49/227 |
| 3,646,707 | 3/1972 | Lystad | 49/227 |
| 4,089,134 | 5/1978 | Koike | 49/227 |
| 4,442,632 | 4/1984 | Greco et al. | 49/352 |
| 4,503,639 | 3/1985 | Rossie et al. | 49/227 X |

*Primary Examiner*—Philip C. Kannan

*Attorney, Agent, or Firm*—Stephenson and Boller

[57] ABSTRACT

Window glass regulator for automotive vehicles comprising a guide plate having curved, parallel guide slots inclined from the vertical, a generally vertical guide rail fixed to said plate, a glider plate slidable along said guide rail, the glide plate having generally horizontal guide slots, a window glass having a pair of laterally extending guides adjacent its lower edge extending through the guide slots in both of the guide plate and glider plate to determine an irregular upward path of movement for the window glass and means for raising and lowering the glide plate.

15 Claims, 5 Drawing Figures

SIDE WINDOW GLASS REGULATOR FOR QUARTER WINDOWS ON CONVERTIBLES

BRIEF SUMMARY

The present invention relates to means for raising and lowering an automobile window glass, particularly the quarter window on convertibles although not explicitly limited to use on convertibles. In its lowered position this window glass is retracted into space provided between the inner and outer surfaces of the side walls of the side of the automobile. In its fully raised position it completely closes a window space having top, bottom and side edges. The bottom edge of the window space is of course provided with an elongated slot through which the window glass moves between its retracted and its raised closing position.

The window glass usually is curved in a vertical plane and presents its concave side inwardly of the vehicle. It is a requirement, in order to provide an effective seal when the glass is fully raised, that the glass move upwardly in an irregular path which as the glass nears its upper limiting position includes a substantial component forwardly of the vehicle.

In accordance with the present invention, the window glass is supported adjacent its bottom edge by lateral follower pins which are each located by intersecting slots in relatively slidable members.

Vertical movement of the window is guided by generally vertical but laterally curved slots in a stationary guide plate. Lateral movement of the window is permitted by generally horizontal slots in a vertically movable glider plate. Compound rotating in the side view of the glass is possible if the horizontal slots are given a curvature.

Vertical movement of the glider plate may be a manual operation or it may be powered by an electric motor. The actuation of the glider plate may be by cables wound around drums and attached to the glider plate; by a semi-rigid flexible tape; by crossed, rigid pivotally connected arms, or by any other of well known actuators in use today.

DETAILED DESCRIPTION

For purposes of illustration, a simple manually operated regulator is illustrated, but the actuating mechanism may be of any of the types now in use and may be manually or power actuated.

A window glass 10 is illustrated in the upper position at 10*a* and in fully retracted position at 10*b*. It will be observed in FIG. 1, that in its raised position the glass has not only been substantially elevated but has also been displaced forwardly. In addition, as will later appear, the glass travels in an irregularly curved path as it is raised and lowered.

Figure 3:
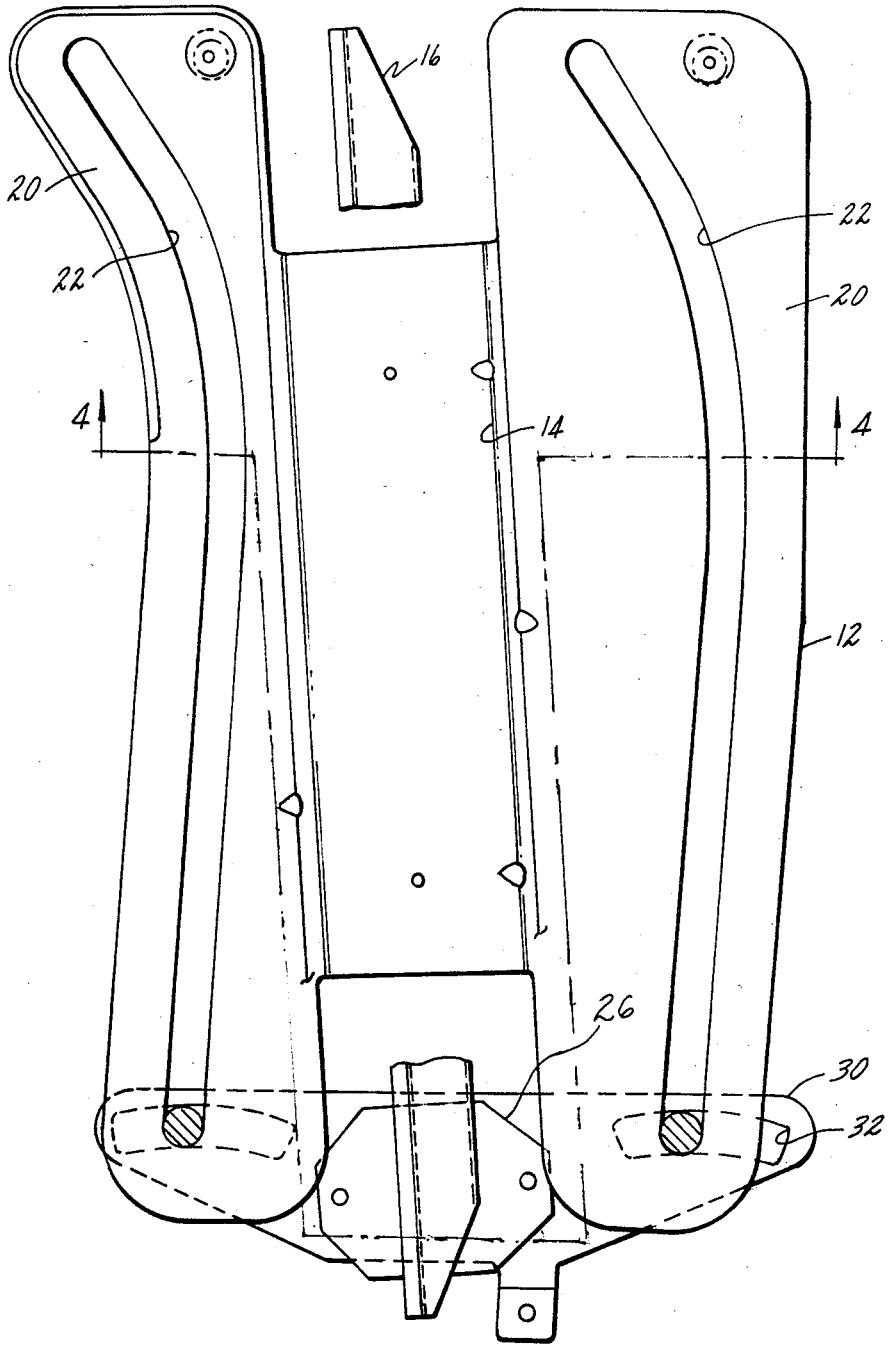
FIG. 3 is an elevation of the guide plate and glider plate assembly.

In order to determine the path along which the glass moves, a stationary guide plate 12 is mounted within the cavity which receives the glass in retracted position. Guide plate 12 is slightly curved in the vertical plane to correspond and be parallel to the front view curvatures of glass 10, and has a depressed channel 14 which is straight as viewed transversely of the vehicle as seen in FIG. 3, but is slightly inclined upwardly and forwardly from the vertical.

Figure 4:
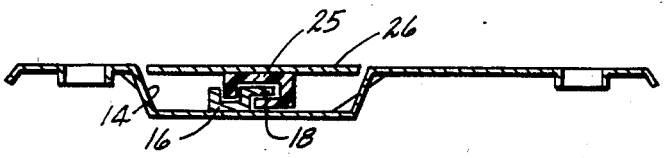
FIG. 4 is a section on line 4—4, FIG. 3.

Within channel formed by channel 14, there is provided a rigid guide rail 16, which follows the lateral curvature of plate 12, but is straight as viewed from the side. As best seen in FIG. 4, the guide rail is in the form of a channel having a stiffening flange 18 extending from one edge of the channel.

The edge portions 20 of guide plate 12 are provided with generally vertical but longitudinally curved, parallel guide slots 22. Conveniently these slots are formed by slitting the material of the guide plate and bending the material adjacent the slits to form reinforcing elements 24*a*, as seen in FIG. 5.

Actuating means are provided comprising plastic gliders 25 slidable longitudinally of channel 14 on guide rail 16 and shaped to interfit with the rail so as to be only slidably movable therealong. Rigidly fixed to the plastic gliders are plate 26 and glider plate 30 having elongated, aligned, horizontal guide slots 32 therein which may be straight or as shown in FIG. 3, curved as required to produce the desired motion of window 10.

As best seen in FIG. 3, guide slots 22 and 32 cross, so that the position of a follower received in both of the slots at the crossing point is determined thereby as the glider plate 30 is raised or lowered.

Figure 5:
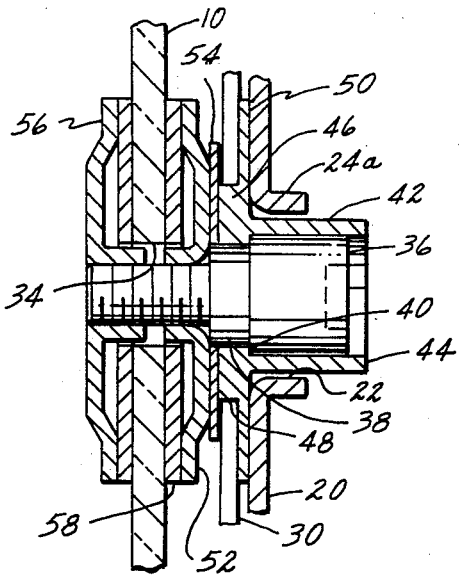
FIG. 5 is an enlarged section view through a guide pin and the slotted plates.

Referring now to FIG. 5, there is illustrated follower structure rigidly fixed to the window glass adjacent its lower edge. In this figure, glass 10 is provided with a pair of spaced openings 34. Through each of these openings extends a guide bolt 36 having a reduced portion 38 defining a shoulder 40. Mounted on bolt 36 is a slide washer 42 having a tubular extension 44 which extends through slot 22. Washer 42 has a thickened portion 46 which seats on the reduced portion 38 of bolt 36, and which at its radially outer portion provides a cylindrical guide surface 48 which is slidable within a slot 32 of glider plate 30. Washer 42 includes a radial extension 50 which is positioned between confronting surfaces of guide plate 20 and glider plate 30.

The assembly described above is completed by a spanner nut 52 threaded on the reduced end of bolt 36 which retains a washer 54 against the thickened portion of washer 42. The assembly is rigidly secured to the glass 10 by spanner nut 52 threaded on reduced end of bolt 36 and a similar nut 56. Nuts 52 and 56 are dished to have clamping pressure with the glass surrounding holes 34 in annular zones spaced substantially from the edges of the holes. Washers 58 are provided between the glass and the clamping portions of nuts 52,56.

Figure 1:
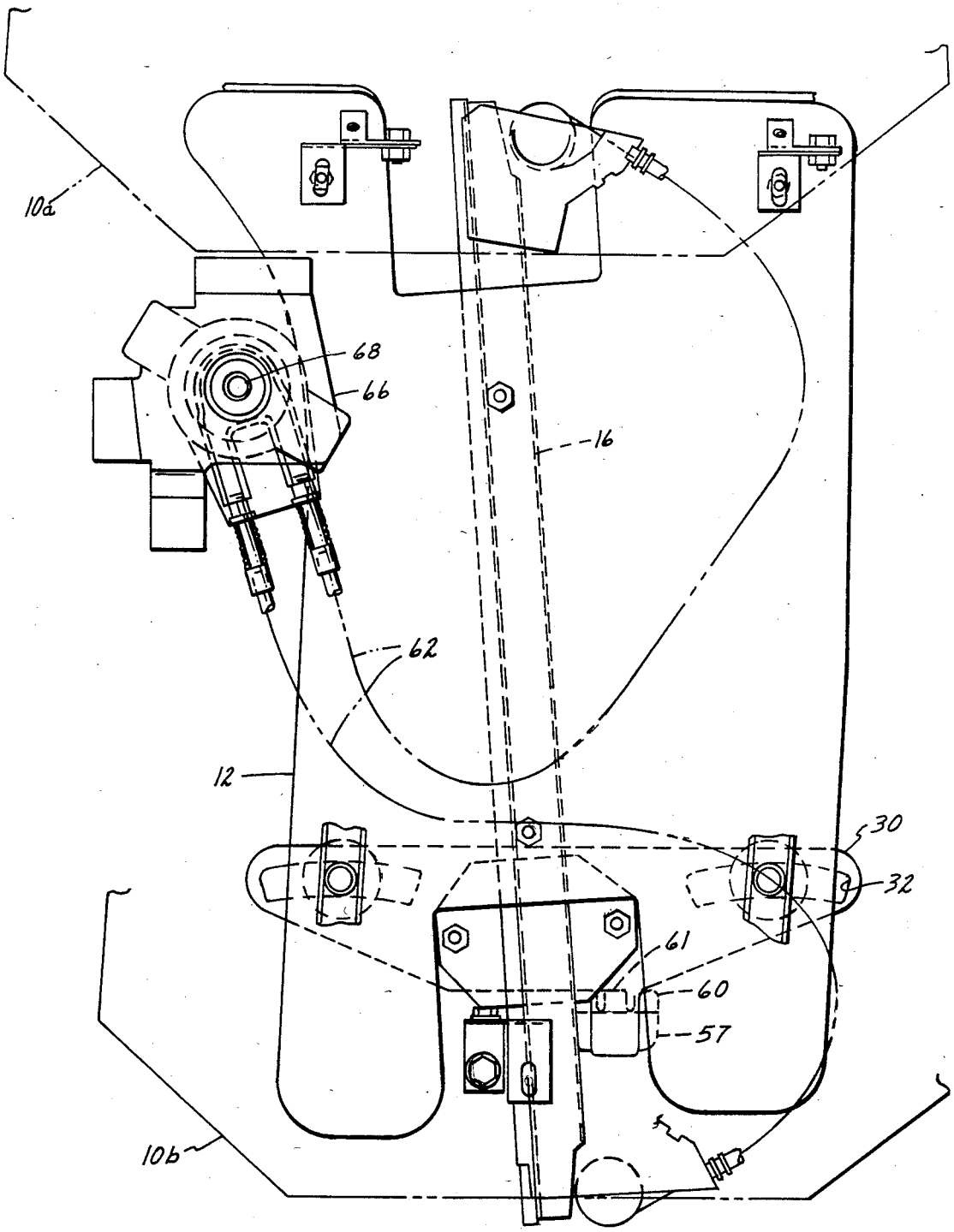
FIG. 1 is a side elevation of the regulator.
Figure 2:
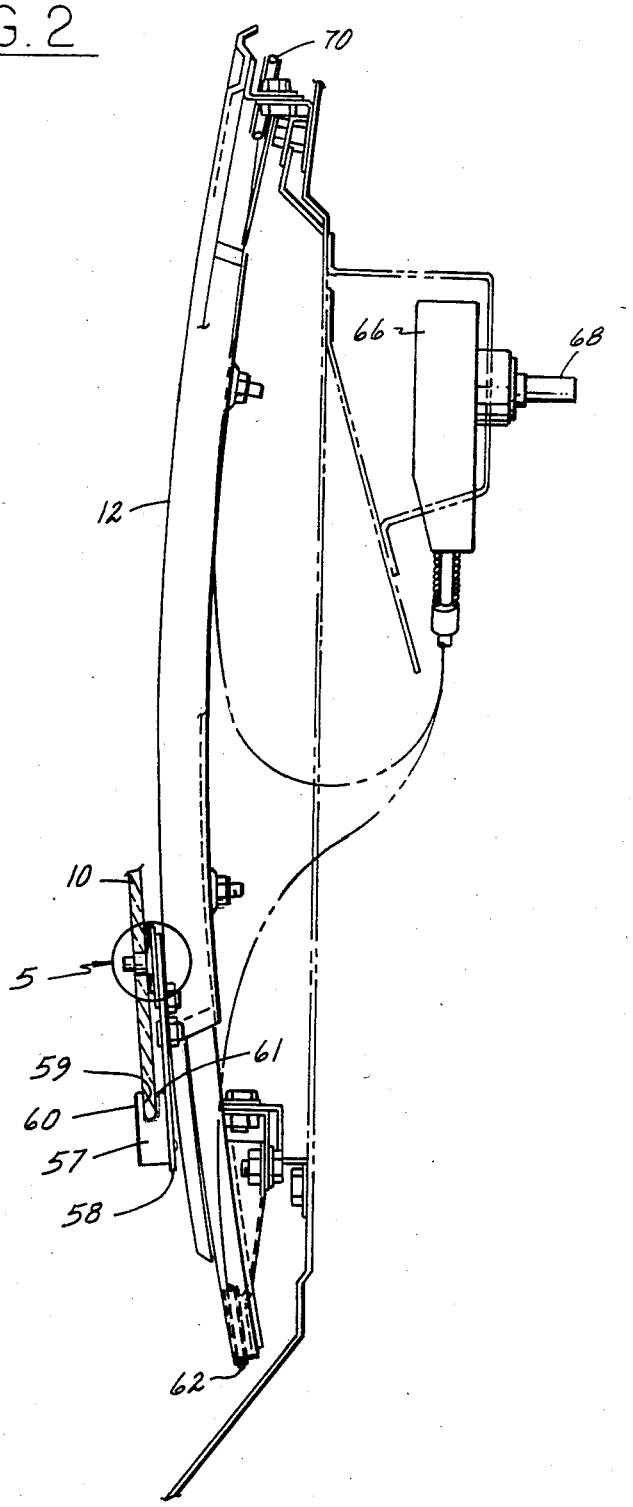
FIG. 2 is a front view of the regulator.

While nuts and bolts 36,52 and 56 clamp the window glass 10 and support it firmly, a slide block 57 is attached by bracket 58 to the vertically movable glider assembly. Block 57 as best seen in FIGS. 1 and 2, has an upwardly open groove 59 defined by fingers 60 and 61 in which the bottom edge of window glass 10 is received. This provides a positive mechanical support to stabilize the glass to reduce lateral instability of the glass in addition to the frictional clamping by the structure including the nuts 52,56.

While the particular mechanism selected to raise and lower glider plate 30 may be any of the known mechanisms in use for this purpose, for completeness there is illustrated herein a manually operated device in which flexible cables 62 are provided in operationally rigid support tubes 64 and are secured to drums (not shown) within the housing 66. The drums may be rotated directly or through suitable gearing from a shaft 68 to which an operating handle may be secured. The cables operate in tension to raise or lower glider plate 30, as is well understood in the art.

Guide rollers 70 are provided at opposite ends of guide rail 16, and the cable is received within the channel in guide rail where the ends thereof are secured to glider 26 to impart substantially vertical movement to glider plate 30.

With the parts in the down position illustrated in FIG. 3, it will be observed that the followers comprising slide washers 42 occupy positions intermediate the ends of slots 32. As the glider plate 30 moves upwardly along the inclined path defined by the rail 16 the followers 42 move first to the right in slots 32 due to the slight rearward and upward inclination of slots 22. As the window nears its uppermost position, slots 22 curve more abruptly forwardly, and the followers 42 approach the left hand ends of slots 22.

The glass is firmly supported on the followers including bolts 42, and since these are separated substantially, the glass is stable in all intermediate positions. When fully raised its edge portions engage locating and sealing means in the window opening.

I claim:

1. A window regulator for an automotive vehicle having a window opening and a housing space beneath the opening and a window slot at the bottom of the opening through which a window glass is movable between a raised position in which it closes the opening and a lowered position in which it is substantially completely concealed in said housing space, a window glass shaped to conform to the window opening and movable through said window slot, generally vertical guide means connected to said window in said space curved to embody portions having components extending forward and rearward of the vehicle, said generally vertical guide means comprising a pair of guides fixed within said housing space, spaced longitudinally of the vehicle, and a pair of followers respectively associated with said guides fixed to said window adjacent the lower edge thereof, actuating means connected to said window adjacent its lower edge and movable generally vertically in said housing space and comprising means connecting said actuating means to said window to provide for relative movement between said window and said actuating means in a direction longitudinal of the vehicle as said window is raised and lowered, and drive means for moving said actuating means generally vertically to raise and lower said window.

2. A regulator as defined in claim 1, in which said guide means comprises a generally vertically disposed plate fixed within said housing space and said guides are in the form of a pair curved guide slots spaced longitudinally of the vehicle in said guide plate.

3. A regulator as defined in claim 2, in which the connection between said window and said vertical guide means comprises a pair of followers attached to said window adjacent the lower edge thereof and slidably received in said guide slots.

4. A regulator as defined in claim 2, in which said actuating means comprises a glider plate slidably mounted on said guide plate.

5. A regulator as defined in claim 4, in which the connection between said glider plate and said window comprises a pair of followers attached to said window adjacent the lower edge thereof and slidably received in said actuating slots.

6. A regulator as defined in claim 1, in which said actuating means comprises a glider plate slidably mounted on said guide plate.

7. A regulator as defined in claim 6, in which said glider plate has generally horizontal therein actuating slots.

8. A window regulator for an automotive vehicle having a window opening and a housing space beneath the opening and a window slot at the bottom of the opening through which a window glass is movable between a raised position in which it closes the opening and a lowered position in which it is substantially completely concealed in said housing space, a window glass shaped to conform to the window opening and movable through said window slot, a generally vertical guide plate fixed within said housing space, a pair of curved guide slots in said guide plate spaced longitudinally of the vehicle, a glider plate slidable generally vertically on said guide plate and having a pair of generally horizontal actuating slots therein spaced longitudinally of the vehicle, actuating and guide pins fixed to said window adjacent the lower edge thereof and received in said guide and actuating slots, and means for raising and lowering said glider plate.

9. A regulator as defined in claim 8, in which said guide slots respectively cross said actuating slots, each of said guide pins being simultaneously slidable in one of said guide slots and the actuating slot which crosses said one guide slot.

10. A regulator as defined in claim 9, in which said guide pins comprise bolts extending through enlarged opening adjacent the lower end of said window, a bearing on said bolt having a first portion dimensioned to fit slidably within a guide slot and an axially spaced portion dimensioned to fit within an actuating slot, and dished nuts on said bolt having annular pressure zone to apply clamping pressure therebetween to said window in an annular zone spaced radially outwardly from the opening in said window.

11. A regulator as defined in claim 9, in which said window is transversely curved to present its concave side inwardly of the vehicle, said guide plate being correspondingly curved to conform to the curvature of said window.

12. A regulator as defined in claim 11, in which guide plate has a rigid guide rail fixed thereto to extend generally vertically, said glider plate having means slidable on said rail and effective to limit relative movement between said rail and glider plate to such sliding movement.

13. A regulator as defined in claim 12, in which said guide rail is curved to conform only to the transverse curvature of the window glass and guide plate but not to the curvature of the guide slots longitudinally of the vehicle.

14. A regulator as defined in claim 13, in which said guide plate is formed with a generally vertically extending channel therein, said guide rail is disposed in said channel, and said glider plate has means affixed thereto received in said channel and slidable on said rail.

15. A regulator as defined in claim 13, comprising a solid support block fixed to said glider plate and slotted to receive the lower edge of said window glass.

* * * * *